US007568338B2

(12) United States Patent
Noelle et al.

(10) Patent No.: US 7,568,338 B2
(45) Date of Patent: Aug. 4, 2009

(54) MULTI-PIECE COMPRESSOR HOUSING

(75) Inventors: Phillipe Noelle, Vincey (FR); Robert Mavir, Skelmersdale (GB)

(73) Assignee: Honeywell International Inc., Morristown, NJ (US)

( * ) Notice: Subject to any disclaimer, the term of this patent is extended or adjusted under 35 U.S.C. 154(b) by 180 days.

(21) Appl. No.: 11/317,636

(22) Filed: Dec. 23, 2005

(65) Prior Publication Data

US 2007/0144173 A1 Jun. 28, 2007

(51) Int. Cl.
*F02B 33/44* (2006.01)

(52) U.S. Cl. ..... 60/605.1; 60/605.2; 415/199.1

(58) Field of Classification Search ..... 60/605.1, 60/605.2; 415/199.1, 199.2
See application file for complete search history.

(56) References Cited

U.S. PATENT DOCUMENTS 4,082,477 A * 4/1978 Kronogard ..... 415/120
4,344,289 A * 8/1982 Curiel et al. ..... 60/612
4,704,075 A * 11/1987 Johnston et al. ..... 417/407
4,705,463 A * 11/1987 Joco ..... 417/407
6,345,503 B1 2/2002 Gladden
6,601,388 B1 * 8/2003 Gladden ..... 60/606
6,792,755 B2 * 9/2004 Arnold et al. ..... 60/602
2002/0114693 A1 * 8/2002 Bartholoma et al. ..... 415/9
2005/0017709 A1 1/2005 Stolfus et al.

FOREIGN PATENT DOCUMENTS

DE 10050931 8/2002
EP 0834646 9/1997
WO 2006063236 6/2006

OTHER PUBLICATIONS

PCT ISR WO PCT/2006/048175.

* cited by examiner

*Primary Examiner*—Hoang M Nguyen
(74) *Attorney, Agent, or Firm*—Lee & Hayes

(57) ABSTRACT

An exemplary compressor housing includes an axis to coincide with a rotational axis of a compressor wheel housed by the compressor housing, an inlet insert that includes an inlet port and a compressor wheel shroud portion that extends away from the inlet port to a ridge and a base component that defines, at least in part, a diffuser section and a scroll wherein the diffuser section extends radially outward to the scroll, wherein the ridge of the inlet insert defines, at least in part, an inlet to the diffuser section and wherein a joint exists between the inlet insert and the base component along a radius in the diffuser section. Various other exemplary technologies are also disclosed.

14 Claims, 6 Drawing Sheets

INTERNAL COMBUSTION ENGINE AND TURBOCHARGER
100

MULTI-PIECE COMPRESSOR HOUSING

TECHNICAL FIELD

Subject matter disclosed herein relates generally to turbochargers for internal combustion engines and, in particular, compressor housings.

BACKGROUND

Turbochargers rely on compression of air to increase performance. However, as no compression process is purely adiabatic, heating of the air occurs. In general, the greater the deviation from adiabatic, the lower the efficiency of the compression process. While many steps have been taken to cool compressed air prior to combustion (e.g., intercoolers, etc.), a need exists for other technologies to reduce heating of inlet air. Various exemplary technologies presented herein are directed to multi-component compressor housings that can reduce heat transfer.

SUMMARY

An exemplary compressor housing includes an axis to coincide with a rotational axis of a compressor wheel housed by the compressor housing, an inlet insert that includes an inlet port and a compressor wheel shroud portion that extends away from the inlet port to a ridge and a base component that defines, at least in part, a diffuser section and a scroll wherein the diffuser section extends radially outward to the scroll, wherein the ridge of the inlet insert defines, at least in part, an inlet to the diffuser section and wherein a joint exists between the inlet insert and the base component along a radius in the diffuser section. Various other exemplary technologies are also disclosed.

BRIEF DESCRIPTION OF THE DRAWINGS

A more complete understanding of the various method, systems and/or arrangements described herein, and equivalents thereof, may be had by reference to the following detailed description when taken in conjunction with the accompanying drawings wherein.

DETAILED DESCRIPTION

Figure 1:
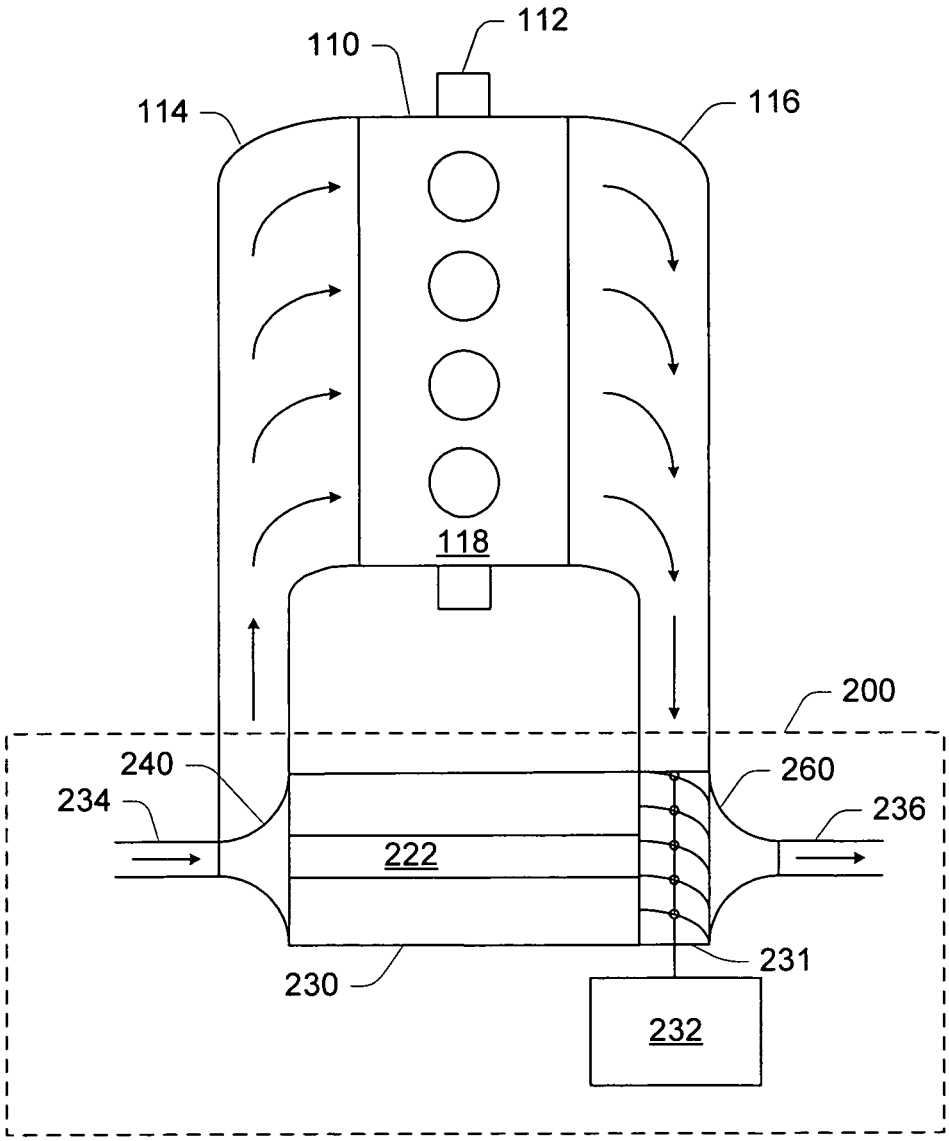
Fig.1 (Prior Art)
FIG. 1 is a simplified approximate diagram illustrating a prior art turbocharger system for an internal combustion engine.

Turbochargers are frequently utilized to increase the power output of an internal combustion engine. Referring to FIG. 1, a prior art power system 100 includes an internal combustion engine 110 and a turbocharger 200. The internal combustion engine 110 includes an engine block 118 housing one or more combustion chambers that operatively drive a shaft 112. An intake port 114 provides a flow path for compressed intake air to the engine block while an exhaust port 116 provides a flow path for exhaust from the engine block 118. The turbocharger 200 acts to extract energy from the exhaust and to provide energy to the intake air.

As shown in FIG. 1, the turbocharger 200 includes an air inlet 234, a shaft 222, a compressor stage 240, a turbine stage 260, a center housing 230 and an exhaust outlet 236. An optional variable geometry unit 231 and a variable geometry controller 232 are also shown, which may use multiple adjustable vanes, a wastegate or other features to control the flow of exhaust. Such a variable geometry unit may be optionally used with the compressor stage 240.

In general, the turbine stage 260 includes a turbine wheel housed in a turbine housing and the compressor stage 240 includes a compressor wheel housed in a compressor housing where the turbine housing and compressor housing connect directly or indirectly to the center housing 230. The center housing 230 typically houses one or more bearings that rotatably support the shaft 222, which is optionally a multi-component shaft. Often, the center housing 230 provides a means for lubricating various turbocharger components. For example, the center housing 230 typically defines a passage or passages for circulating lubricant (e.g., oil) to and from the shaft bearing(s). Lubricant can also function as a coolant to convect thermal energy away from various components.

Various exemplary technologies discussed herein pertain to compressor housing. As described in more detail below, a multi-component compressor housing can offer advantages over a conventional, single piece compressor housing. Exemplary compressor housing are for use with centrifugal compressors, which are well-known in the art, and, as already mentioned, include a rotatable compressor wheel or impeller for axially receiving air or gas for compression. The compressor wheel is rotatably driven within a compressor housing, and includes axially and radially extending compressor blades for drawing in air and for discharging the same at relatively high velocity.

Figure 2A:
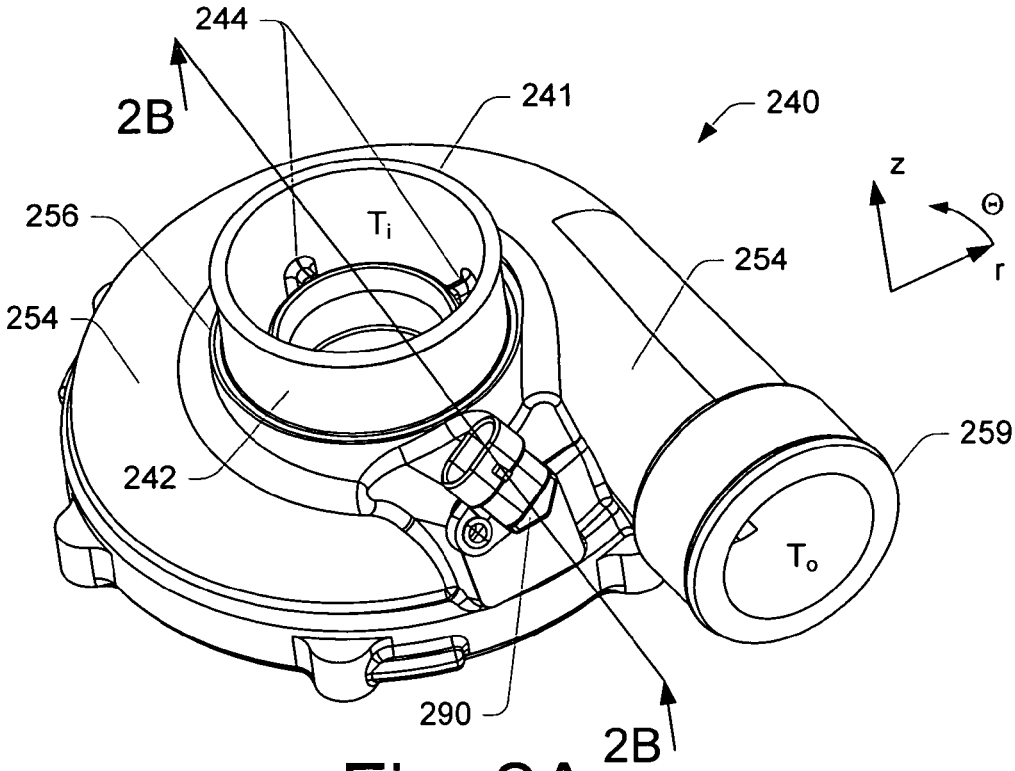
Fig. 2A (Prior Art)
FIG. 2A is a perspective view illustrating a prior art compressor housing.
Figure 2B:
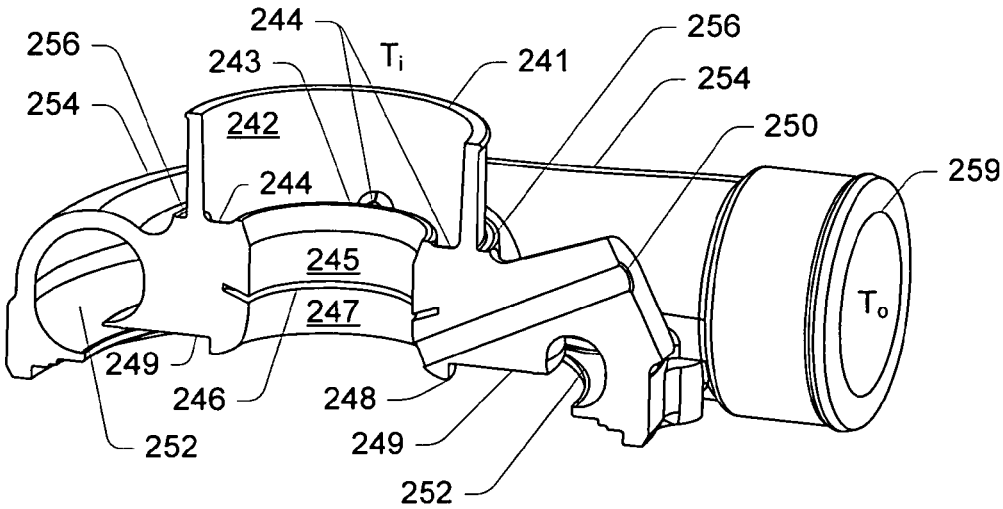
Fig. 2B (Prior Art)
FIG. 2B is a cross-sectional view of the compressor housing of FIG. 2A.

FIG. 2A shows a conventional compressor housing 240 fitted with a sensor 290. FIG. 2B shows a cross-sectional view (along the line 2B-2B) of the compressor housing 240. A cylindrical coordinate system in axial (z), radial (r) and azimuthal directions (Θ) is shown for reference. The compressor housing 240 is one piece cast using, for example, a p-mold (sand cast) process. The compressor housing 240 has an inlet port 241, a scroll wall 254 and an outlet port 259. As already mentioned, the compression process heats the air entering the inlet port 241 ($T_i$) such that the exit temperature the outlet port ($T_o$) may rise to a temperature of about 200° C. or more, depending on the particular turbocharger, pressure ratio, outside air temperature (e.g., $T_i$), etc. The temperature of the compressor housing 240 ($T_c$) rises due to energy transfer from the air to walls of the various passages. While other sources may contribute to an increase in temperature of the compressor housing 240, the main source is of heating is normally due to compression of the inlet air.

With respect to the various walls and passages, the compressor housing 240 includes an annular wall 242 that extends axially downward toward the scroll wall 254 where an outer surface of the annular wall 242 joins the scroll wall 254 at a juncture 256. An inner surface of the annular wall 242 extends downward past the axial level of the juncture 256 in a plurality of regions where the regions are divided by bridges 244. The bridges 244 bridge the wall 242 and a compressor wheel shroud portion of the compressor housing 240.

The compressor wheel shroud portion includes an upper shroud portion 245 and a lower shroud portion 247. An upper edge 243 of the shroud portion bevels downward to the upper shroud portion 245. A gap 246, defined by a lower edge of the upper shroud portion 245 and an upper edge of the lower shroud portion 247, provides passages for air to flow between the aforementioned plurality of regions and the shroud portion of the compressor housing 240. In operation, air may flow from the shroud portion through the gap 246 to the plurality of regions and re-enter the shroud portion. Such flow may reduce noise or be used to manage operational range of a compressor.

The lower shroud portion 247 extends downward to a ridge 248. Noting that a sensor port 250 opens along the lower shroud portion 247 as well, just above the ridge 248. The sensor port 250 allows for positioning of a sensor (e.g., the sensor 290), which may be a sensor capable of sensing rotational speed of a compressor wheel housed by the compressor housing 240.

The ridge 248 generally defines, in part, a diffuser section inlet. The diffuser section relies on an upper surface 249 that extends radially outward to the scroll 252, which is defined at least in part by the scroll wall 254. For the given coordinate system, the cross-sectional area of the scroll 252 in the r-z plane decreases with increasing angle Θ. The scroll 252 receives air at from the diffuser section and provides air at the outlet port 259 of the compressor housing 240. The diffuser section may receive vanes or one or more other mechanisms that act to control the flow of air to the scroll 252.

As described herein various exemplary technologies pertain to a thermally decoupled compressor housing. Such technologies can reduce transfer of heat energy to air in a compressor housing. As a consequence, an improvement in aerodynamic performance may be realized. Further, such technologies can be used to adjust temperature distribution and minimum and maximum temperature of a compressor housing. As a consequence, temperature-limited sensor technology may be utilized.

Figure 3A:
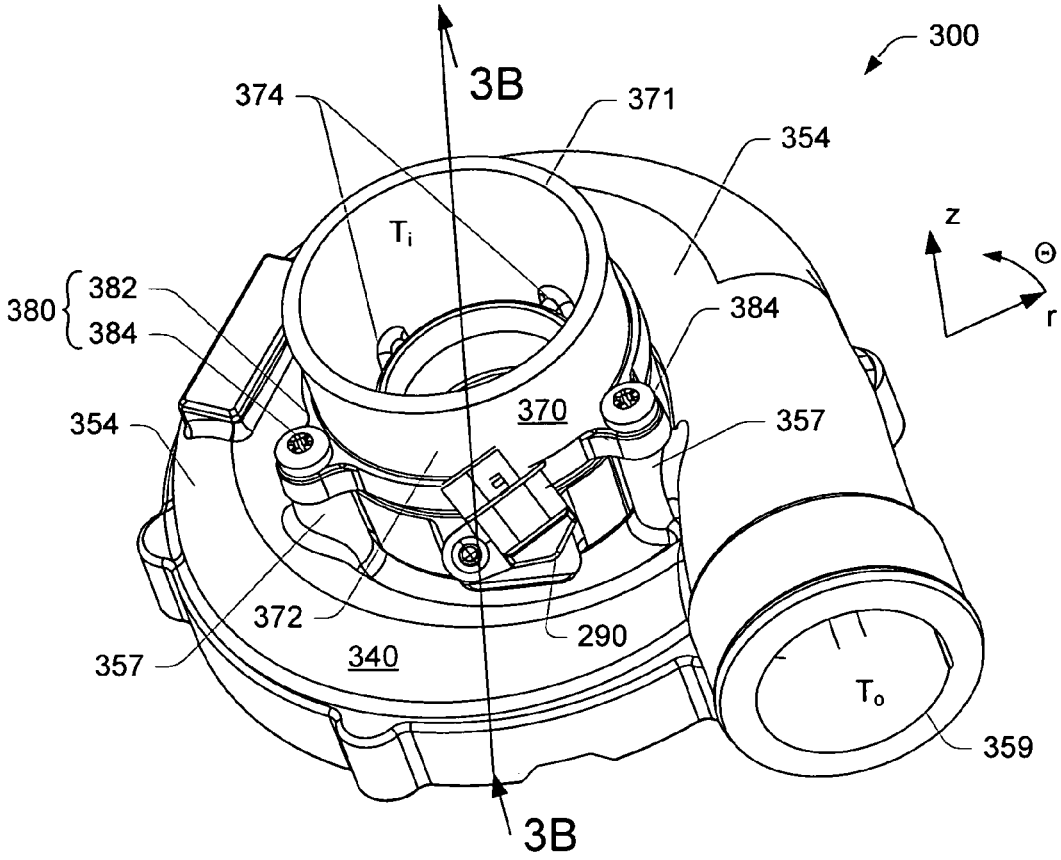
FIG. 3A is a perspective view illustrating an exemplary multi-component compressor housing.
Figure 3B:
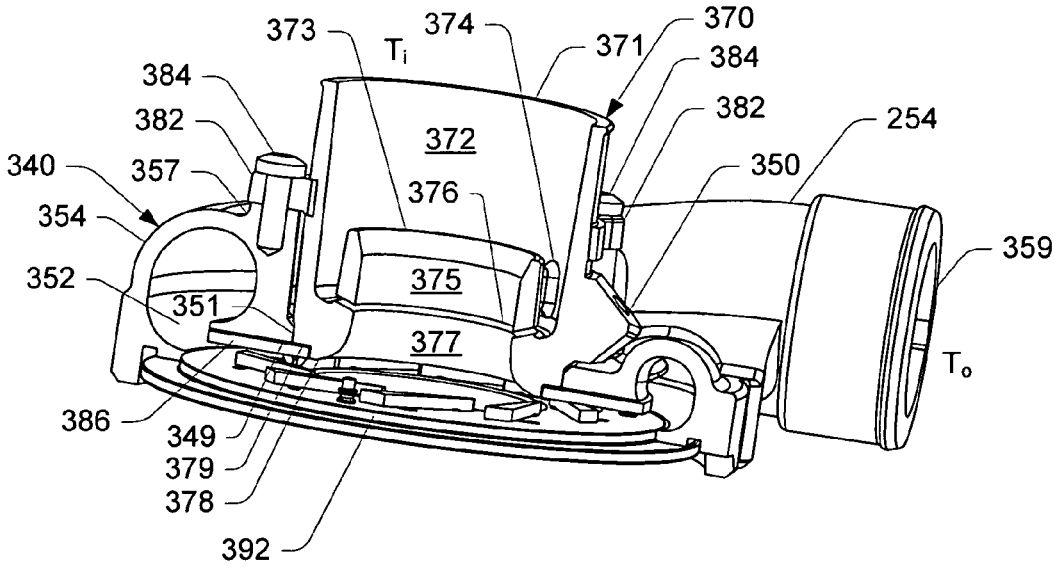
FIG. 3B is a cross-sectional view of the compressor housing of FIG. 3A.

FIG. 3A shows an exemplary compressor housing 300 that includes features for thermal decoupling. In particular, the compressor housing 300 include multiple components arranged to decouple thermal conduction in the housing 300. FIG. 3B shows a cross-sectional view of the housing 300 (along the line 3B-3B) to reveal an optional variable geometry mechanism 392 to adjust flow in a diffuser section.

The compressor housing 300 includes a base component 340, an inlet insert 370 and an attachment mechanism 380 to attach the inlet insert 370 to the base component 340. The inlet insert 370 has an inlet port 371 while the base component 340 has a scroll wall 354 and an outlet port 359. The arrangement of the inlet insert 370 and base component 340 acts to reduce energy transfer from the base component 340 to the inlet insert 370. The attachment mechanism 380 is provided as an example as various alternative attachment mechanisms may be used. An attachment mechanism generally does not allow for heat transfer that would defeat decoupling achieved by the overall arrangement of components.

The inlet insert 370 includes an annular wall 372 that extends axially downward to the base component 340 where an outer surface of the annular wall 372 joins the base component 340 at a joint 351. In this example, at the joint 351, a substantially cylindrical surface of the base component 340 meets a substantially cylindrical surface of the wall 372 of the inlet insert 370. In general, the contact surface area at the joint 351 is sufficient to provide some stability for the inlet insert 370 while minimizing conductive heat transfer. An insulating material is optionally used to insulate and/or secure the joint 351. In this example, the attachment mechanism 380 (see below) is the primary mechanism for securing the inlet insert 370 to the base component 340.

An inner surface of the annular wall 372 extends downward in a plurality of regions where the regions are divided by bridges 374. The bridges 374 bridge the wall 372 and a compressor wheel shroud portion of the inlet insert 370.

The compressor wheel shroud portion of the inlet insert 370 includes an upper shroud portion 375 and a lower shroud portion 377. An upper edge 373 of the shroud portion bevels downward to the upper shroud portion 375. A gap 376, defined by a lower edge of the upper shroud portion 375 and an upper edge of the lower shroud portion 377, provides passages for air to flow between the aforementioned plurality of regions and the shroud portion of the inlet insert 370. In operation, air may flow from the shroud portion through the gap 376 to the plurality of regions and re-enter the shroud portion.

A configuration with such a gap may be referred to as a "ported shroud". More particularly, a ported shroud may have an angular slot machined in a slot contour that provides a flow path between a location down stream the leading edge of a compressor wheel and a passage that leads to the inlet duct upstream of the wheel. A ported shroud can be used to increase the width of a compressor map with some expected loss in efficiency.

As described herein, an exemplary compressor housing may include a base component and a selectable inlet insert. For example, a user may select an inlet insert with a compressor wheel shroud portion configuration. If the configuration does not perform as expected, then the user may simply detach the inlet insert and select another inlet insert with a more suitable configuration (e.g., gap width, contour, axial height, etc.).

The lower shroud portion 377 extends downward to a ridge 378. Noting that a sensor port 350 opens along the lower shroud portion 377 as well, just above the ridge 378. The sensor port 350 allows for positioning of a sensor (e.g., the sensor 290), which may be a sensor capable of sensing rotational speed of a compressor wheel housed by the compressor housing 300.

The ridge 378 generally defines, in part, a diffuser section inlet. As for the diffuser section, a substantially disk-shaped component 386 is seated with respect to a surface 349 of the base component 340 and a surface 379 of the inlet insert 370 to thereby provide an upper surface for the diffuser section of the compressor housing 300. The component 386 thus that extends radially outward from near or at the ridge 378 to the scroll 352, which is defined at least in part by the scroll wall 354. The scroll 352 receives air at from the diffuser section and provides air at the outlet port 359 of the base component 340 of the compressor housing 300. Again, in this example, the diffuser section receives vanes associated with a variable geometry mechanism 392 that acts to control the flow of air to the scroll 352.

The component 386 may be constructed from a material with a low thermal conductivity. In one example, the component 386 is secured to the base component 340 and/or the inlet insert 370 using a liquid adhesive or sealant that transforms or hardens to a solid state capable of withstanding the operational conditions of the compressor housing 300. Further, such an adhesive may be applied such that an air space(s) is (are) formed between the component 386 and the base component 340 and/or the inlet insert 370. A stagnant air space may act to insulate the various components. In such an example, the component 386 may not directly contact the base component 340 and/or the inlet insert 370.

In one example, two rings of liquid sealant are used for the component 386, one ring for the inlet insert 370 and one ring for the base component 340. In this example, an o-ring or other similar seal may not be required. In other examples, (e.g., a fixed geometry compressor or other), a seal ring such as an o-ring may be used between one or more components (e.g., an inlet insert and a base component).

In the example of FIGS. 3A and 3B, the attachment mechanism 380 relies on a plurality of bosses 357 of the base component 340 and an equal number of protruding links 382 attached to or integral with the inlet insert 370. As shown in FIG. 3B, a space exists between a boss 357 and the inlet insert 370 (generally along the axial direction as the boss 357 rises from the base component 340). Such a space reduces heat transfer between the base component 340 and the inlet insert 370. Each boss 357 includes a bore for receiving a bolt 384 that passes through a respective link 382 to thereby secure the inlet insert 370 to the base component 340. The bolts 384 are optionally constructed from a material with a low thermal conductivity to thereby reduce conduction from the base component 340 to the inlet insert 370. Where the protruding links 382 are not integral to the inlet insert 370, they may be constructed from a material with a low thermal conductivity. Further, the links 382 may be part of a ring that fits via a compression or other fit to the inlet insert 370 where the ring is optionally constructed from a material with a low thermal conductivity. In all of these examples, an insulating material may be used between the base component 340 and the inlet insert 370.

Figure 4:
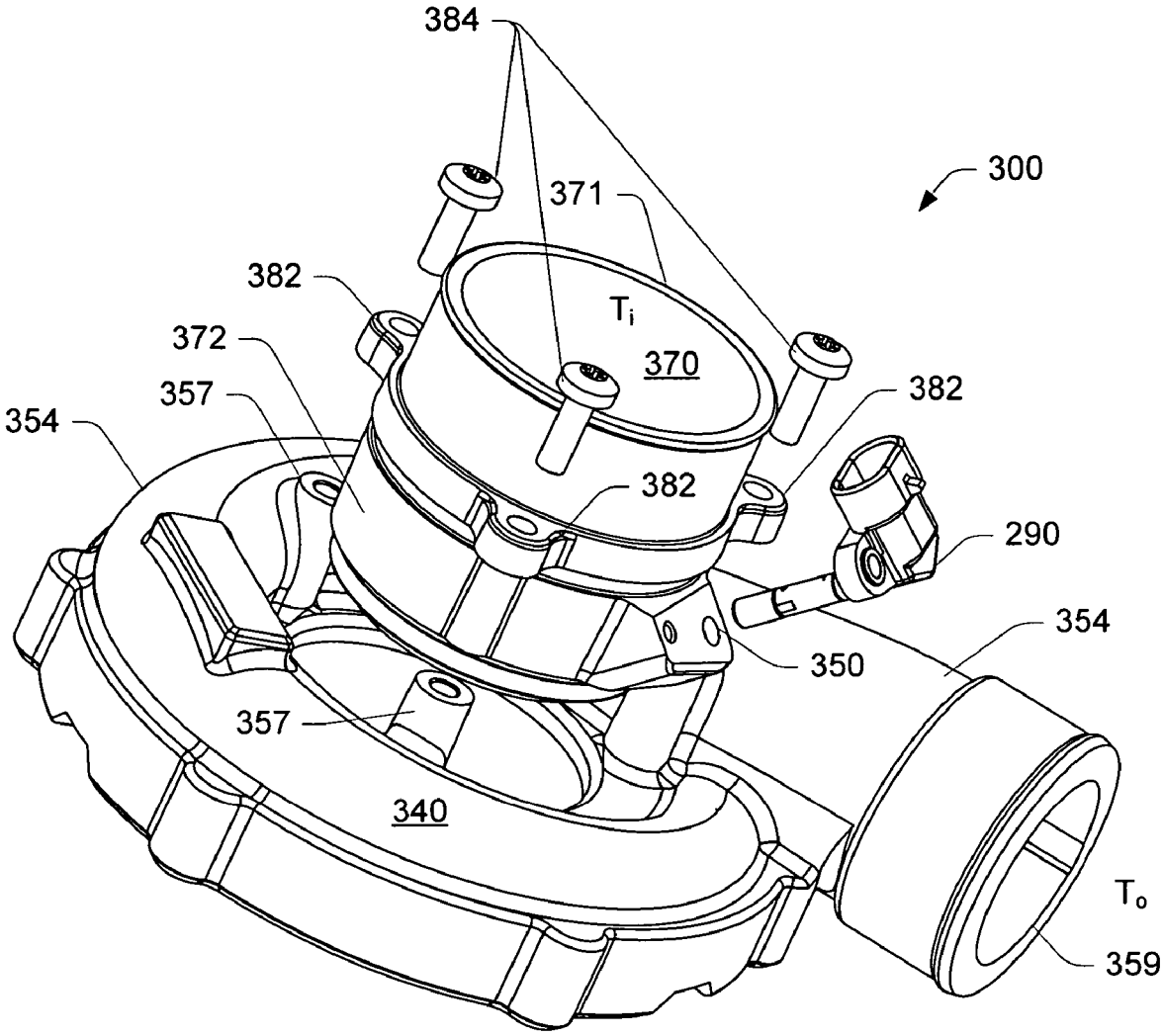
FIG. 4 is a cross-sectional view of the compressor housing of FIG. 3A shown with approximate temperature contours that demonstrate reduction of heat transfer.

FIG. 4 shows an exploded view of the exemplary compressor housing 300 of FIGS. 3A and 3B that illustrates cooperation between the various components. For example, with respect to the attachment mechanism 380, three bosses 357 include bores to receive three bolts 384 to thereby secure the inlet insert 370 to the base component 340. The sensor port 350 receives the sensor 290. The sensor port 350 is associated with the inlet insert 370, which is to some extent thermally decoupled from the base component 340.

An exemplary compressor housing includes an axis (e.g., z-axis) to coincide with a rotational axis of a compressor wheel housed by the compressor housing, an inlet insert that includes an inlet port and a compressor wheel shroud portion that extends away from the inlet port to a ridge and a base component that defines, at least in part, a diffuser section and a scroll wherein the diffuser section extends radially outward to the scroll. In such a compressor housing, the ridge of the inlet insert defines, at least in part, an inlet to the diffuser section and a joint exists between the inlet insert and the base component along a radius in the diffuser section (a radius from the axis). Such a compressor housing may include a sensor port having an opening along the compressor wheel shroud.

As already described, a base component may include one or more bosses to secure an inlet insert to the base component. An inlet insert may include one or more links that cooperate with the one or more bosses to secure the inlet insert to the base component. As shown in FIG. 4, the one or more bosses extend axially away from the diffuser section and have a substantially cylindrical shape, which may aid cooling as the bosses may conduct heat to the inlet insert, directly or indirectly. In other examples, surfaces associated with a joint may provide the only means for heat conduction between a base component and an inlet insert.

Referring to FIGS. 3A and 3B, the attachment mechanism may include one or more contact surfaces between the inlet insert and the base component and wherein the one or more contact surfaces reside axially between the compressor wheel shroud portion and the inlet port of the inlet insert. For example, the bosses 357 may extend axially upward to above the level of the edge 373 of the shroud portion of the inlet insert 370. The bosses may be shaped to have surface area to provide cooling and thereby reduce the temperature at any associated contact surface.

Figure 5:
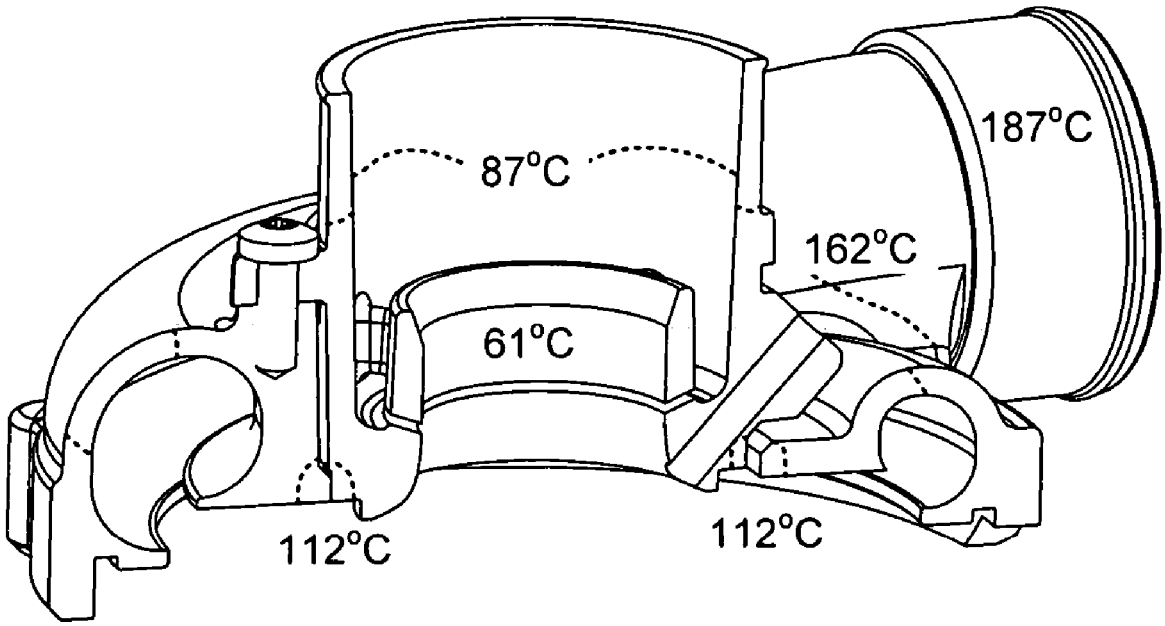
FIG. 5 is a diagram of an exemplary valve that includes a spool and two associated operational states.

Trials to examine temperature distributions were performed using finite element analysis software (ANSYS, Inc., Canonsburg, Pa.). FIG. 5 shows an example of trial results for the exemplary compressor housing 300 of FIGS. 3A, 3B and 4. In the trial results of FIG. 5, material properties for aluminum were used for the exemplary compressor housing. In various examples, the inlet insert can be constructed from aluminum or one or more other materials. The base component may be constructed from aluminum or one or more other materials. One or more components may be coated (e.g., at a contact surface) to maximize thermal resistance of the individual layers of the wall.

With respect to the trial results of FIG. 5, the lowest temperature was associated with the compressor wheel shroud (about 61° C.) of the inlet insert 370 while the highest temperature was associated the base component 340 near the outlet port 359 (about 187° C.). The minimum temperature for the base component 340 was about 115° C., near the boss located the furthest away from the outlet port 359. The maximum temperature for the inlet insert 370 was at the link closest to the outlet port 359 (about 127° C.). In comparison to a single piece compressor housing, a temperature reduction of approximately 20° C. is realized. Such a reduction can be translated into performance gains. Such a reduction can result in opportunities to use sensor technologies that otherwise would not be possible or practical (e.g., due to temperature-by-time longevity or reliability).

Figure 6:
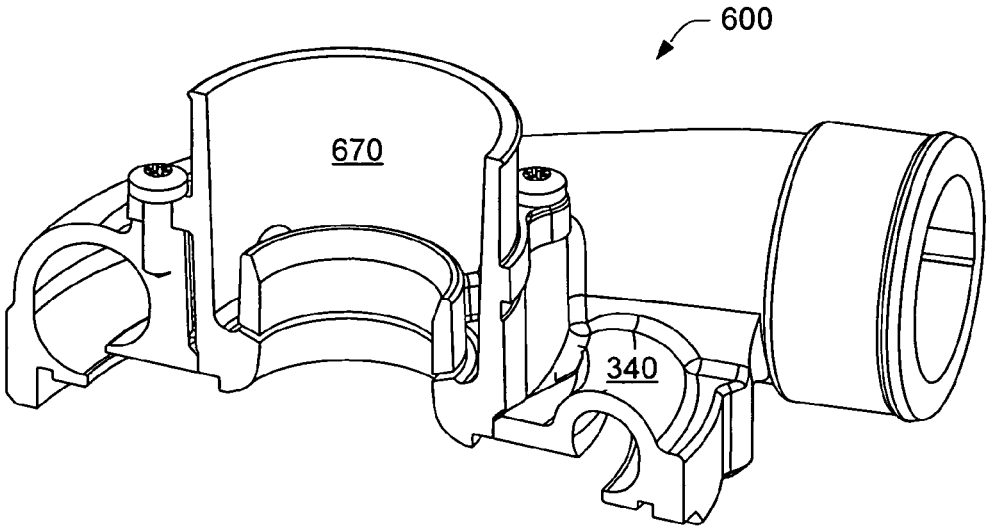
FIG. 6 is a cross-sectional view of an exemplary compressor housing that includes an inlet insert without a sensor port.

The exemplary compressor housing 300 included a sensor port 350 associated with the inlet insert 370. FIG. 6 shows an exemplary compressor housing 600 that includes the base component 340 of FIGS. 3A, 3B and 4 and an inlet insert 670 that does not include a sensor port.

Figure 7:
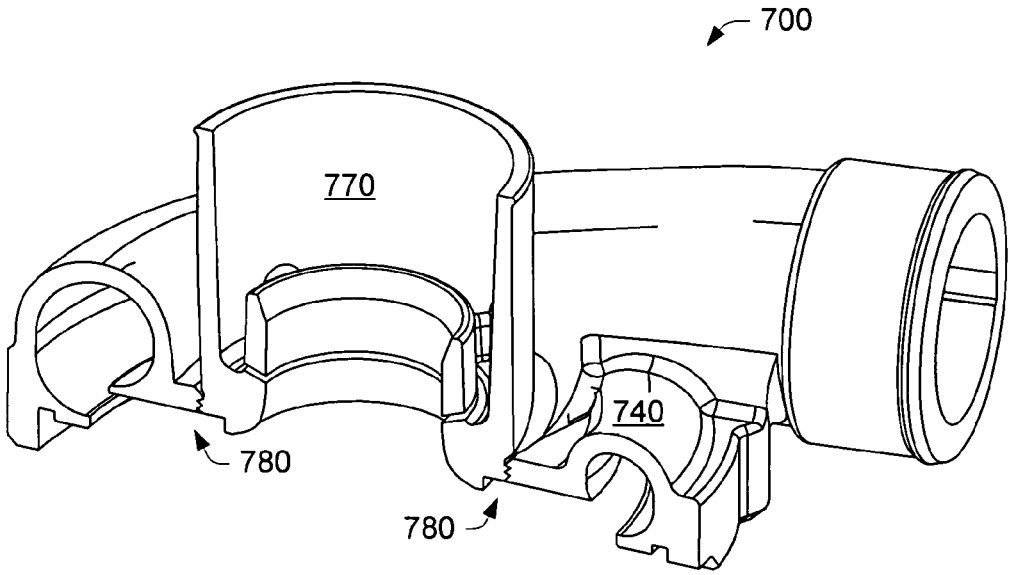
FIG. 7 is a cross-sectional view of an exemplary compressor housing with an alternative attachment mechanism.

The exemplary compressor housing 300 included the attachment mechanism 380. FIG. 7 shows an exemplary compressor housing 700 that includes a base component 740 and an inlet insert 770 whereby a threaded or bayonet attachment mechanism 780 provides for attachment of the inlet insert 770 to the base component 740.

As described herein, various exemplary compressor housings use two main components, a inlet insert and a base component that reduce contact surface and therefore minimize thermal conduction between the inlet portion and the rest of the compressor housing. Trials demonstrate that the temperatures of a speed sensor region and inlet region for a multi-component compressor housing are lower than those for a one piece compressor housing.

Although exemplary methods, devices, systems, etc., have been described in language specific to structural features and/or methodological acts, it is to be understood that the subject matter defined in the appended claims is not necessarily limited to the specific features or acts described. Rather, the specific features and acts are disclosed as exemplary forms of implementing the claimed methods, devices, systems, etc.

The invention claimed is:

1. A compressor housing for a turbocharger, the compressor housing comprising:

an axis to coincide with a rotational axis of a compressor wheel housed by the compressor housing;

an inlet insert comprising an inlet port, an annular wall that extends axially downward from the inlet port, a compressor wheel shroud portion inset from the annular wall wherein the shroud portion extends away from the inlet port to a ridge, and a sensor port having an opening along the compressor wheel shroud portion; and a base component that defines, at least in part, a diffuser section and a scroll wherein the diffuser section extends radially outward to the scroll, wherein the base component comprises axially extending bosses to secure the inlet insert to the base component, wherein the bosses provide surface area to aid in cooling the base component and to reduce temperature at contact points for securing the inlet, and wherein a respective space exists between each of the bosses and the inlet insert to reduce heat transfer between the bosses and the inlet insert;

wherein the ridge of the inlet insert defines, at least in part, an inlet to the diffuser section and wherein a joint exists between the inlet insert and the base component along a radius in the diffuser section.

2. The compressor housing of claim 1 wherein the inlet insert comprises links that cooperate with the bosses to secure the inlet insert to the base component.

3. The compressor housing of claim 1 wherein the bosses extend axially away from the diffuser section.

4. The compressor housing of claim 3 wherein each of the bosses comprises a substantially cylindrical shape.

5. The compressor housing of claim 1 further comprising an attachment mechanism to attach the inlet insert to the base component.

6. The compressor housing of claim 5 wherein the attachment mechanism comprises one or more contact surfaces between the inlet insert and the base component and wherein the one or more contact surfaces reside axially between the compressor wheel shroud portion and the inlet port of the inlet insert.

7. A turbocharger comprising the compressor housing of claim 1.

8. The compressor housing of claim 1 wherein the sensor port having the opening along the compressor wheel shroud portion comprises an axis non-orthogonal to the rotational axis to thereby position a sensor at an angle between the inlet insert and the base component to reduce heat transfer to the sensor.

9. The compressor housing of claim 1 comprising the sensor port positioned approximately mid-way between two of the bosses to thereby reduce heat transfer from the bosses to the sensor port.

10. The compressor housing of claim 2 wherein the one or more links comprise a material of construction of lower thermal conductivity compared to a material of construction of the inlet insert.

11. The compressor housing of claim 2 wherein the one or more links comprise part of a ring that fits to the inlet insert.

12. A compressor housing for a turbocharger, the compressor housing comprising:

an axis to coincide with a rotational axis of a compressor wheel housed by the compressor housing;

an inlet insert comprising an inlet port, a compressor wheel shroud portion that extends away from the inlet port to a ridge and a sensor port having an opening along the compressor wheel shroud portion; and a base component that defines, at least in part, a diffuser section and a scroll wherein the diffuser section extends radially outward to the scroll;

wherein the ridge of the inlet insert defines, at least in part, an inlet to the diffuser section and wherein a joint exists between the inlet insert and the base component along a radius in the diffuser section;

wherein the base component further comprises at least two bosses to secure the inlet insert to the base component; and wherein the inlet insert comprises the sensor port positioned approximately mid-way between two of the bosses to thereby reduce heat transfer from the bosses to the sensor port.

13. A compressor housing for a turbocharger, the compressor housing comprising:

an axis to coincide with a rotational axis of a compressor wheel housed by the compressor housing;

an inlet insert comprising an inlet port, a compressor wheel shroud portion that extends away from the inlet port to a ridge and a sensor port having an opening along the compressor wheel shroud portion; and a base component that defines, at least in part, a diffuser section and a scroll wherein the diffuser section extends radially outward to the scroll;

wherein the ridge of the inlet insert defines, at least in part, an inlet to the diffuser section and wherein a joint exists between the inlet insert and the base component along a radius in the diffuser section;

wherein the base component further comprises axially extending bosses wherein the bosses provide surface area to aid in cooling the base component and to reduce temperature at contact points for securing the inlet, and wherein a respective space exists between each of the bosses and the inlet insert to reduce heat transfer between the bosses and the inlet insert;

wherein the inlet insert comprises one or more links that cooperate with the bosses to secure the inlet insert to the base component; and wherein the one or more links comprise a material of construction of lower thermal conductivity compared to a material of construction of the inlet insert.

14. A compressor housing for a turbocharger, the compressor housing comprising:

an axis to coincide with a rotational axis of a compressor wheel housed by the compressor housing;

an inlet insert comprising an inlet port, an annular wall that extends axially downward from the inlet port, a compressor wheel shroud portion inset from the annular wall wherein the shroud portion extends away from the inlet port to a ridge, and a sensor port having an opening along the compressor wheel shroud portion;

a base component that defines, at least in part, a diffuser section and a scroll wherein the diffuser section extends radially outward to the scroll, wherein the base component further comprises at least two bosses to secure the inlet insert to the base component and wherein the sensor port is positioned approximately mid-way between two of the bosses to thereby reduce heat transfer from the bosses to the sensor port;

wherein the ridge of the inlet insert defines, at least in part, an inlet to the diffuser section and wherein a joint exists between the inlet insert and the base component along a radius in the diffuser section.

* * * * *